United States Patent [19]

Morinaga

[11] 4,237,586

[45] Dec. 9, 1980

[54] BUCKLE DEVICE FOR SAFETY BELT

[75] Inventor: Masaru Morinaga, Yamoto, Japan

[73] Assignee: NSK-Warner K.K., Tokyo, Japan

[21] Appl. No.: 952,989

[22] Filed: Oct. 20, 1978

[30] Foreign Application Priority Data

| | | | |
|---|---|---|---|
| Dec. 16, 1977 | [JP] | Japan | 52-168257[U] |
| Dec. 10, 1977 | [JP] | Japan | 52-166043[U] |
| Oct. 21, 1977 | [JP] | Japan | 52-141494[U] |

[51] Int. Cl.[3] ..... A44B 19/00

[52] U.S. Cl. ..... 24/230 A; 362/103; 24/230; 24/230AK

[58] Field of Search ..... 24/230 A, 230 AK; 362/100, 103, 155, 800

[56] References Cited

U.S. PATENT DOCUMENTS

| | | | |
|---|---|---|---|
| 3,166,146 | 1/1965 | Shaw | 24/230 R |
| 3,431,606 | 3/1969 | Jantzen | 24/230 |
| 3,605,209 | 9/1971 | Alarcon | 24/230 |
| 3,708,838 | 1/1973 | Gonzalez | 24/230 A |
| 3,729,923 | 5/1973 | Brigliano | 362/103 X |
| 3,774,268 | 11/1973 | Holmberg | 24/230 A |
| 3,895,196 | 7/1975 | Lewis | 24/230 A X |
| 3,956,603 | 5/1976 | Fisher | 24/230 A X |
| 3,994,049 | 11/1976 | Johansen | 24/230 A |
| 4,078,248 | 3/1978 | Hill | 362/100 |
| 4,136,425 | 1/1979 | Esner | 24/230 A |

FOREIGN PATENT DOCUMENTS

| | | |
|---|---|---|
| 52-97831 | 4/1977 | Japan . |
| 4556 | 2/1976 | United Kingdom . |

*Primary Examiner*—Nile C. Byers, Jr.

*Attorney, Agent, or Firm*—Shapiro and Shapiro

[57] ABSTRACT

A buckle device for safety belts having a latch member pivotally mounted to a base member which serves as a load member and engageable with notches of a tongue member when the tongue is inserted into the base member so as to latch the base member and the tongue member together, resilient member for biasing the latch member in notches engaging direction, and a manually operable member for moving the latch member against the bias of the resilient member to unlatch the tongue member. Either of the latch member and the operable member has camming surfaces which engage engaging portions of the other of the above two members, whereby the sliding movement in the tongue insertion direction of the operable member is transformed to the substantially pivotal movement of the latch member.

7 Claims, 15 Drawing Figures

BUCKLE DEVICE FOR SAFETY BELT

BACKGROUND OF THE INVENTION

1. Field of the Invention

This invention relates generally to a buckle device for safety belt adapted for use principally in vehicles.

2. Description of the Prior Art

Heretofore, among the buckle devices, there have been ones in which a button member is slid to thereby move a latch member in a pivotal fashion or in a direction perpendicular to the direction of tongue insertion to effect engagement and disengagement between the tongue and the latch member. However, many of these have the disadvantages respecting the number of parts and the size and shape thereof, so that they cannot be said to be sufficient in ease of manufacture of the device, compactness of the device or smoothness of the disengagement between the tongue and the latch member. The present invention has been made in view of these points.

SUMMARY OF THE INVENTION

It is therefore a first object of the present invention to provide a buckle device which comprises a relatively small number of small-dimensioned and simply-shaped parts and to realize a buckle device which is easy to be manufactured, compact and economical in price.

It is a second object of the present invention to realize a buckle device which is easy to assemble in a stack fashion.

It is a third object of the present invention to realize a buckle device in which the cam surface of one of the button member and the latch member is uniquely contrived for smooth disengagement.

Such objects may be achieved by a buckle device which comprises chiefly a base member, a simple but uniquely configured latch member supported for movement on the base member and having a latch portion movable between a first and a second positions which are substantially in upper and lower relationship as viewed from the base member, a biasing member for the latch member, a tongue for insertion into the base member, and a button member slidable on the base member substantially in parallel with the flat bottom portion thereof to thereby move the latch portion of the latch member between said first position and said second position, said button member and said latch member having cam surfaces for operating the other one to cause the cam surface of the latch means to move away from the base member and the tongue being engaged with the latch member when the latch portion of the latter is in its first or second position to be fixed relative to the base member.

DESCRIPTION OF THE PREFERRED EMBODIMENTS

Description will hereinafter be made in connection with embodiments embodying the technical idea of the present invention.

Figure 1:
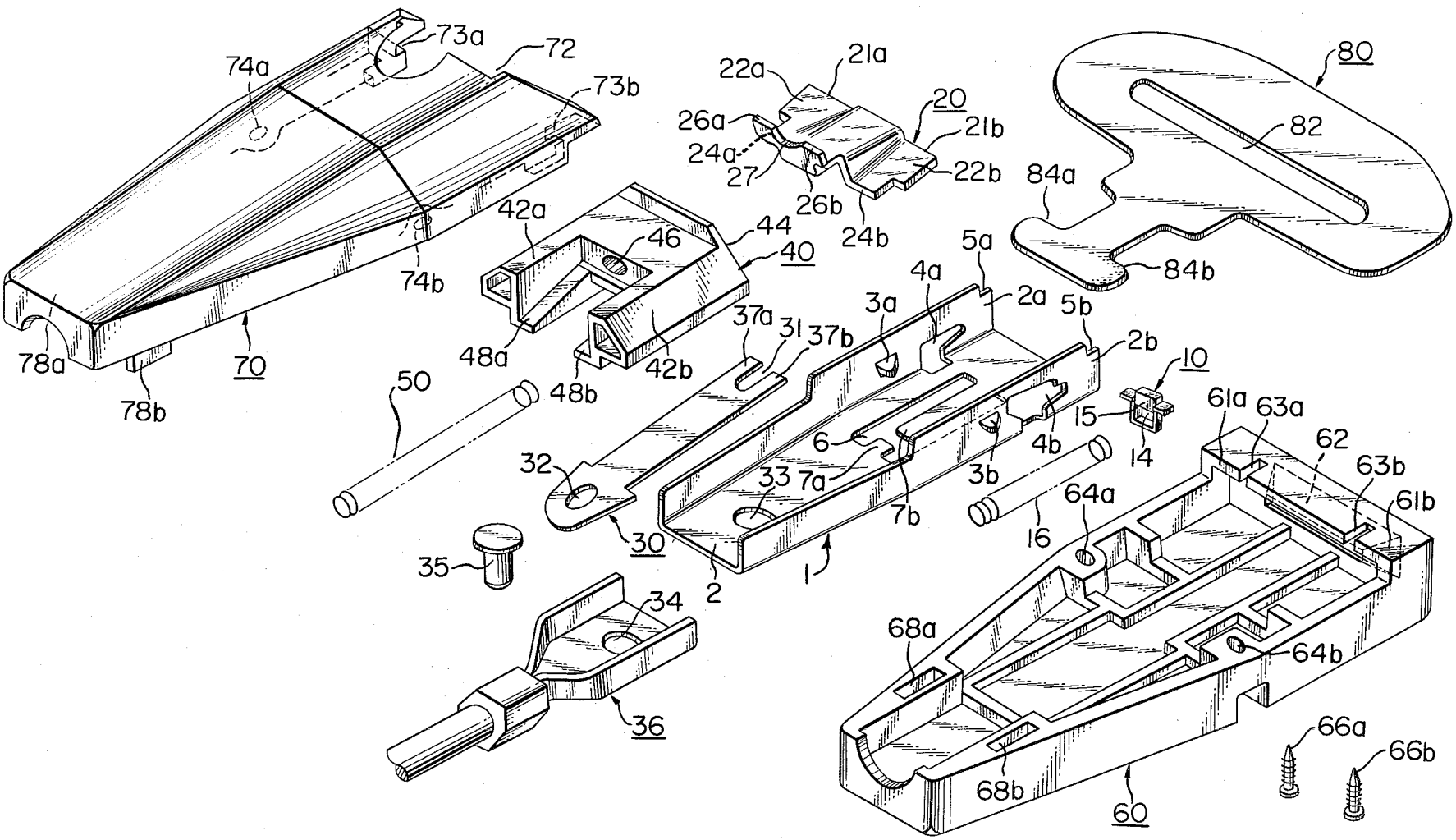
FIG. 1 is an exploded perspective view of a first embodiment of the present invention.

FIG. 1 is an exploded perspective view of a first embodiment of the present invention. The buckle device shown there comprises chiefly a base member 1, a slider 10 slidably mounted along the longitudinal direction of the base member, a latch member 20 having latch portions 24*a* and 24*b* provided on the base member for generally pivotal movement, a plate spring member 30 having one end secured to the base member by a rivet 35 and the other end riding on the upper ends 26*a* and 26*b* of a tail of the latch member, a button member 40 having cam surfaces 48*a* and 48*b*, and a tongue 80 having cut-away portions 84*a* and 84*b* for engaging with the latch portions 24*a* and 24*b* of the latch member and an oblong opening 80 through which an unshown belt passes. The base member generally indicated by 1 comprises a flat bottom portion 2 and up-standing portions 2*a* and 2*b* on the opposite lateral sides of the portion 2. The flat bottom portion 2 is formed with a substantially H-shaped hole 6 to thereby provide a short projection 7*a* and a long projection 7*b* opposed to each other. A slider 10 having a through-hole 14 is fitted into the long projection 7*b* and forwardly (towards the right in FIG. 1) biased by a coil spring 16, which has one end fitted into the long projection 7*b* and received on the cut-away end face 15 of the slider 10 and the other end fitted into the short projection 7*a*.

The up-standing portions 2*a* and 2*b* of the base member 1 are formed with opposed holes 4*a* and 4*b* for pivotally receiving therein the latch member 20. Ears 22*a* and 22*b* formed on the opposite sides of the latch member 20 are loosely fitted in the holes 4*a* and 4*b*, whereby the latch member 20 is supported for generally pivotal movement. These holes 4*a* and 4*b* are so configured that the latch member 20 is obliquely fitted and set in position. The latch member 20 has a projection projected rearwardly and upwardly, and this projection is divided at its end into a bifurcate tail. Similarly bifurcated ends 37*a* and 37*b* of the plate spring member 30, configured as part of the latching structure, are engaged with the upper ends 26*a* and 26*b* of the tail to downwardly bias the latch member 20 substantially about the forward end faces 21*a* and 21*b* thereof. A circular hole 32 is formed at the opposite end portion of the plate spring member 30. This circular hole 32, a circular hole 34 formed in an end of a member 36 for mounting the buckle device in a predetermined position which is adjacent to the buckle device, and a circular hole 33 formed in the flat bottom portion 2 of the base member are aligned with one another so as to permit a rivet 35 to pass therethrough and secure those members integrally with one another.

Above such plate spring member 30 and the latch member 20, there is a button member 40 slidable on the upper end surfaces of the up-standing portions 2*a* and 2*b* of the base member 1. The button member 40 has upwardly sloped cam surfaces 48*a* and 48*b* at the insides of the rearwardly projected bifurcated portions 42*a* and 42*b*, and when the button member 40 is rearwardly slid with the lower ends of the tail of the latch member 20 engaged with these cam surfaces the said lower ends move upwardly away from the base member 1, and the latch member 20 is upwardly pivoted against the biasing force of the plate spring member 30. The lower portions of the bifurcated portions 42*a* and 42*b* may preferably be projected downwardly from the bottom surface of the button member 40, whereby the sliding movement of the button member 40 on the upper end surfaces of the up-standing portions 2*a* and 2*b* of the base member 1 is guided and limited within a predetermined range. Furthermore, a bore 46 extend forwardly from the rear end face of the recession of the button member 40 and receives one end of a coil spring 50, the other end of which is received on a laterally extending rib 77 provided on the inner surface of an upper cover member 70 for covering the button member 40, the base member 1, or the like, as is clear in FIGS. 2 and 3. Thus, the button member 40 is normally biased forwardly. Here, it should be noted that the coil spring 50 can be stretched without interference because of the space 27 in the bifurcated tail of the latch member 20 and the space 31 between the bifurcated ends 37*a* and 37*b* of the plate spring member 30.

The upper cover 70 has its foremost portion providing a cut-away 72 for the button member 40 and is provided with projections 78*a* and 78*b* in the rear portion thereof, threaded bores 74*a* and 74*b* substantially in the intermediate portion thereof, and cut-aways 73*a* and 73*b* in the fore portion thereof. These are fitted to or aligned with slots 68*a* and 68*b*, threaded bores 64*a* and 64*b* and turned back portions 61*a* and 61*b* of a lower cover member 60, respectively, so as to combine the upper and lower cover members 70 and 60 with each other for covering the base member 1 and so on.

Screws 66*a* and 66*b* are threaded into the aligned threaded bores 74*a*, 64*a* and 74*b*, 64*b*, and slits 63*a* and 63*b* of the turned back portion of the lower cover member 60 bear against cut-aways 5*a* and 5*b* of the up-standing portions of the base member 1, whereby a tongue insertion inlet 62 of the lower cover member 60 and the front opening of the base member 1 are aligned with each other.

Figure 2:
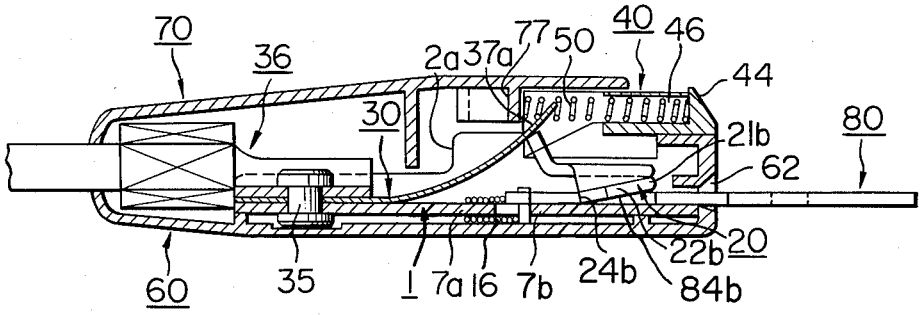
FIG. 2 is a longitudinal cross-sectional view of the device of FIG. 1 when the tongue and the latch member are in meshing engagement with each other.

In FIG. 2, there is shown the manner in which the tongue 80 inserted through the tongue insertion inlet 62 meshes with the latch member 20. At this time, the latch portions 24*a* and 24*b* of the latch member 20 are in their first position. The position of the forward end faces 21*a* and 21*b* of the latch member 20 which are in contact with the forward edges of the holes 4*a* and 4*b* in the up-standing portions 2*a* and 2*b* of the base member 1 are above the position of the latch portions 24*a* and 24*b* of the latch member 20 meshing with the cut-aways 84*a* and 84*b* of the tongue 80. Thus, even if one tries to draw out the tongue 80 in the state shown in FIG. 2, the engagement between the latch member 20 and the tongue 80 is not broken because the latch member 20, subjected to a counter-clockwise torque substantially about the forward end faces 21*a* and 21*b* by the plate spring member 30, is further subjected to a torque in the same direction.

Figure 3:
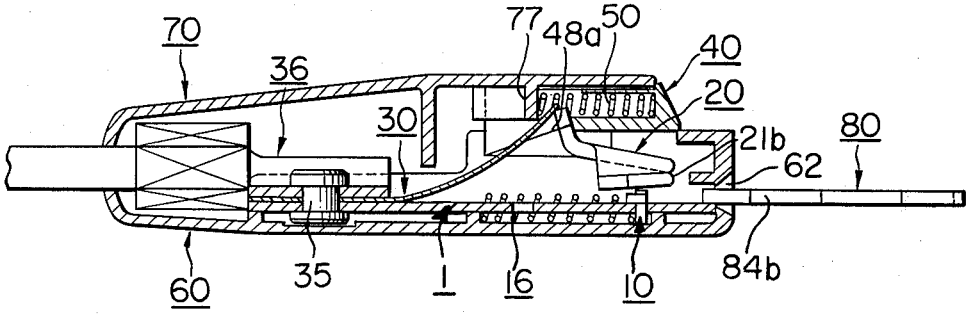
FIG. 3 is a longitudinal cross-sectional view of the device of FIG. 1 when the tongue is disengaged from the latch member.

Here, by applying a force to an inclined front face 44 of the button member 40 as by fingers, the button member 40 is caused to slide backwardly. Thereupon, as shown in FIG. 3, the rearwardly projected portion of the latch member 20 is raised by the cam surfaces 48*a* and 48*b* and the latch member 20 is pivoted clockwisely in FIG. 3 substantially about the forward end faces 21*a* and 21*b* against the biasing force of the plate spring member 30. Thus, the latch portions 24*a* and 24*b* come to assume a second position. In this position, the latch portions 24*a* and 24*b* are retracted to above the upper surface of the tongue 80, so that the engagement between the latch portions 24*a* and 24*b* and the cut-away portions 84*a* and 84*b* of the tongue is released and at the same time the slider 10 is forwardly slid by the coil spring 16 which has so far accumulated its force of restitution, whereby the tongue 80 is driven out forwardly. Also, it should be noted that the slider 10 stays in its forwardly slid position until the tongue 80 is then inserted, thereby maintaining the latch portions 24*a* and 24*b* in its second position. Thus, when the tongue 80 is inserted, the tongue 80 need not raise the latch portions 24*a* and 24*b* the latch member 20, thereby preventing false locking. Preferably, the up-standing portions 2*a* and 2*b* may be provided with embossed portions 3*a* and 3*b* so as to prevent the tongue 80 from floating from the flat bottom portion 2 of the base member 1 when the tongue 80 is inserted.

Figure 4:
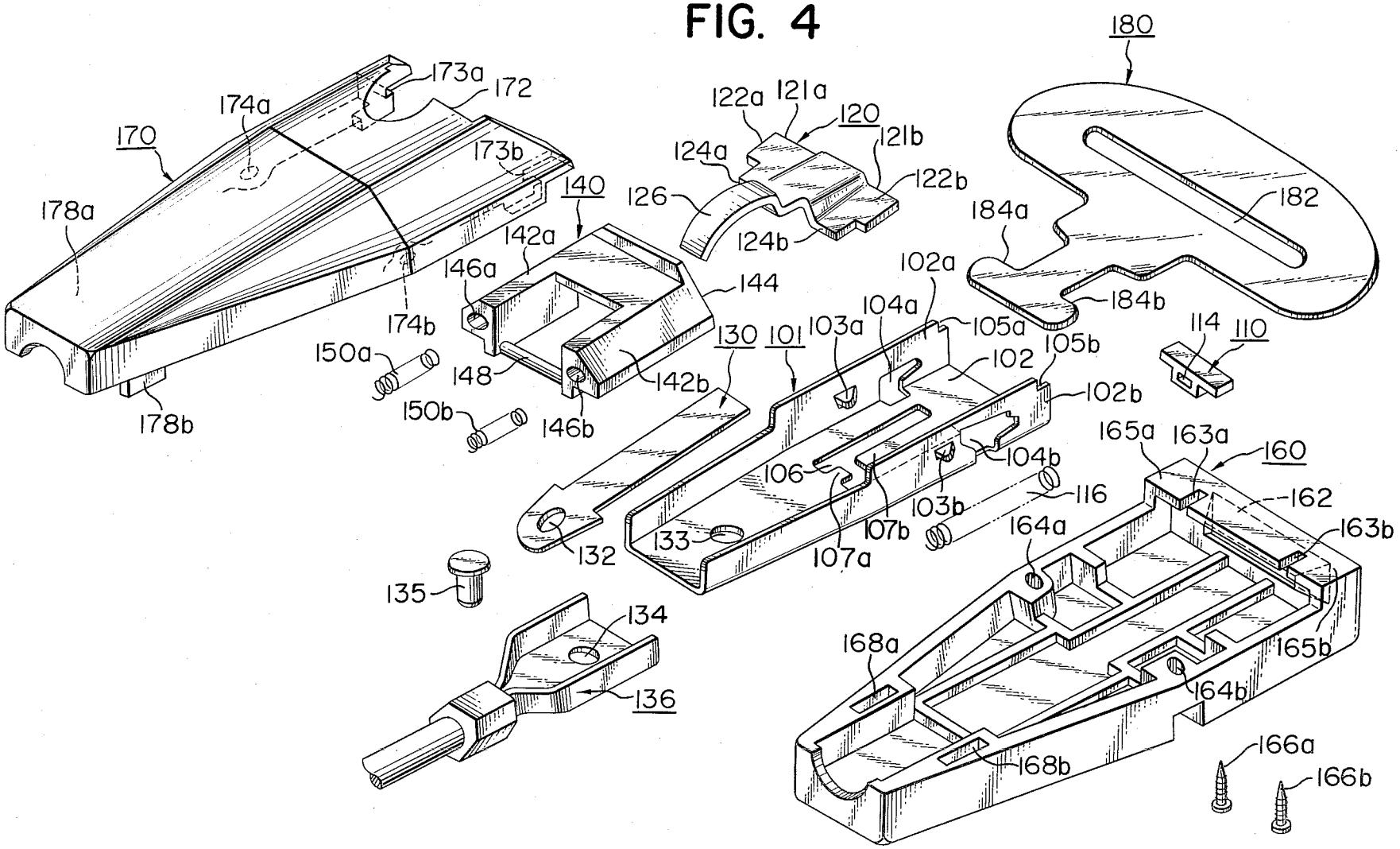
FIG. 4 is an exploded perspective view of a second embodiment of the present invention.

Next, a second embodiment of the present invention will be described in detail referring to FIGS. 4 to 6. This embodiment comprises chiefly a base member 101, a slider 110 disposed for sliding on the base member along the length thereof, a latch member 120 having latch portions 124*a* and 124*b* disposed for generally pivotal movement on the base member 101, a plate spring 130 as part of the latching structure having one end secured to the base member 101 by a rivet 135 and having the other end riding on an upper surface of a cam surface forming portion 126 of the latch member 120, a button member 140 having an engaging bar 148 slidable while engaging the curved lower surface of the cam surface forming portion 126, upper and lower cover members 170 and 160, and a tongue 180 having cut-away portions 184*a* and 184*b* which mesh with the latch portions 124*a* and 124*b* of the latch member.

The base member 101, a member 136 having a circular hole 134, the upper and lower cover members 170 and 160, and the tongue 180 of this second embodiment are the same as those of the first embodiment. In the second embodiment shown in FIGS. 4 to 6, portions corresponding to the portions of the first embodiment are indicated by reference numerals made by adding of a hundred to the corresponding reference numerals of the first embodiment.

So, only the different portions will be referred to hereinafter. The configuration of the latch member 120 is such that it has the cam surface forming portion 126 convexly curved and rearwardly projected. On the upper surface of the cam surface forming portion 126, as mentioned previously, the said other end of the plate spring 130 rides to bias the latch member 120 counterclockwise about the forward end faces 121*a* and 121*b* therof. This end of the plate spring 130 is not bifurcated.

Above the plate spring 130 and the latch member 120, there is the button member 140 which is slidable on upper surfaces of up-standing portions 102*a* and 102*b* of the base member 101. This button member 140 has bifurcated and rearwardly extending projections 142*a* and 142*b*, and the engaging bar 148 laterally crossing between the inner sides of the rearmost portions of these projections 142*a* and 142*b*. Since this engaging bar 148 extends crossing the cam surface of the underside of the cam surface forming portion 126 of the latch member 120, the latch member 120 is pivoted upwardly away from said base member 1 against the biasing force of the plate spring 130 when the button member 140 is slidden rearwardly. The inner and lower surfaces of the projections 142*a* and 142*b* of the button member 140 should preferably project downwardly, whereby the sliding movement of the button member 140 on the upper end surfaces of the upstanding portions 102*a* and 102*b* of the base member may be positively guided. Bores 146*a* and 146*b* extend forwardly from the rear end surfaces of the projections 142*a* and 142*b* of the button member 140. One end of each of coil springs 150*a* and 150*b* enters into respective ones of the bores 146*a* and 146*b*, and the other ends of the springs 150*a* and 150*b* are received by a laterally extending rib provided in the inner surface of the upper cover member 170, as is apparent from FIGS. 5 and 6. Thus, the button member 140 is always biased forwardly.

Figure 5:
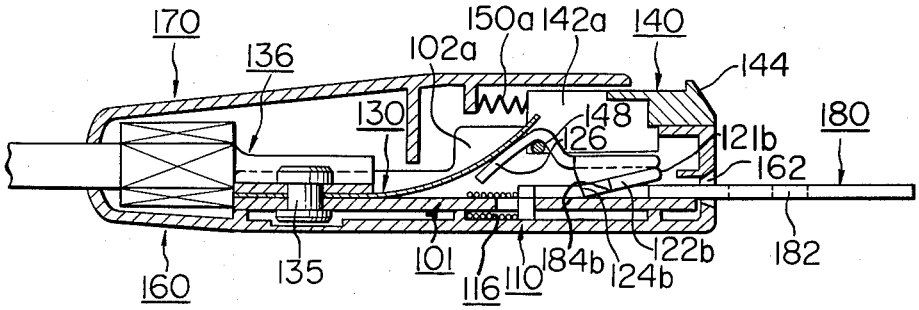
FIG. 5 is a longitudinal cross-sectional view of the device of FIG. 4 when the tongue and the latch member are in meshing engagement with each other.
Figure 6:
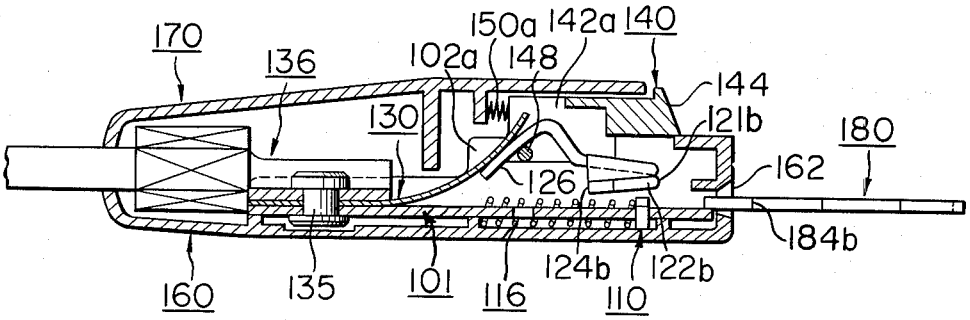
FIG. 6 is a longitudinal cross-sectional view of the device of FIG. 4 when the tongue is disengaged from the latch member.

Reference will now be made to FIGS. 5 and 6 to describe the operation of such second embodiment.

FIG. 5 shows a state in which the tongue 180 is inserted through a tongue insertion inlet 162 to mesh with the latch member 120. At this time, the latch member 120 is in its downwardly pivoted position because the engaging bar 148 of the button member 140 is in contact with the most retired surface of the cam surface of the underside of the cam surface forming portion 126 of the latch member. The position of the foremost end faces 127*a* and 127*b* of the latch member 120 which are in contact with the forward edges of the holes 104*a* and 104*b* in the up-standing portions 102*a* and 102*b* of the base member 101 are above the position of the latch portions 124*a* and 124*b* of the latch member 120 which is engaged with the cut-away portions 184*a* and 184*b* of the tongue 180, viewed from the flat bottom portion 102 of the base member 101.

Subsequently, the button member 140 is rearwardly slid as by imparting a force to the front inclined portion 144 of the button member 140 by a finger. Thereupon, as shown in FIG. 6, the engaging bar 148 is moved rearwardly to come into contact with the rear portion of the cam surface of the cam surface forming portion 126 of the latch member 120, and simultaneously therewith the bar 148 raises the cam surface forming portion 126 and further pivots the entire latch member 120 clockwise about the forward end faces 127*a* and 127*b* against the biasing force of the plate spring 130. When the latch member comes to this position, the latch portions 124*a* and 124*b* are retracted upwardly from the upper surface of the tongue 180, so that the mesh engagement between the latch portions 124*a* and 124*b* and the cut-away portions 184*a* and 184*b* of the tongue 180 is broken up and at the same time, the slider 110 is forced out forwardly by the coil spring 116 which has so far stored its force of restitution. Thus, the tongue 180 is driven out forwardly.

Figure 8:
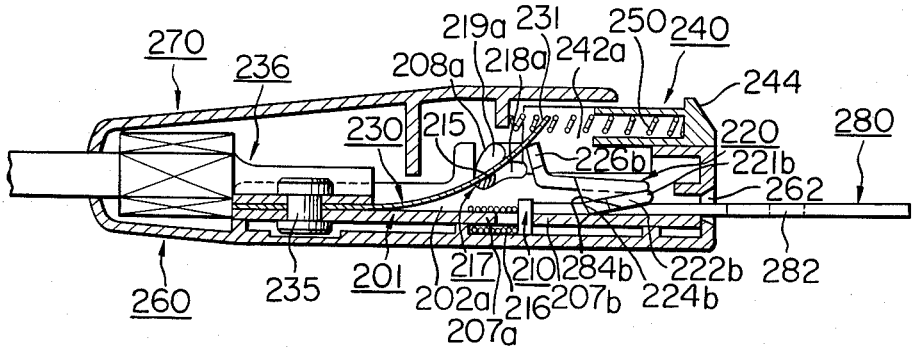
FIG. 8 is a longitudinal cross-sectional view of the device of FIG. 7 when the tongue and the latch member are in meshing engagement with each other.
Figure 9:
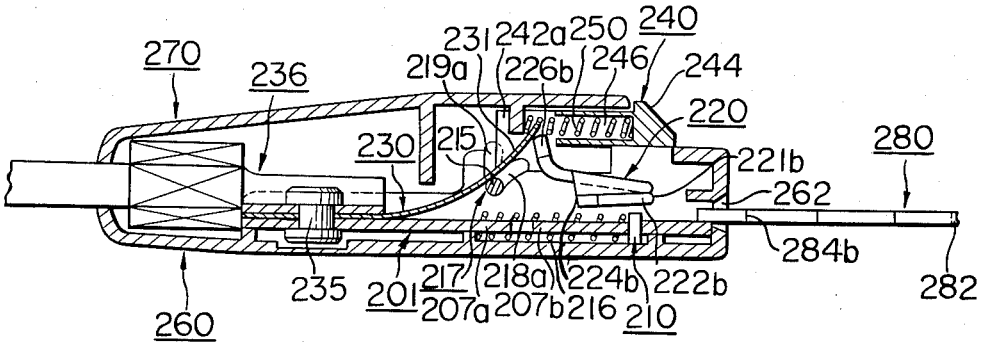
FIG. 9 is a longitudinal cross-sectional view of the device of FIG. 7 when the tongue is disengaged from the latch member.
Figure 7:
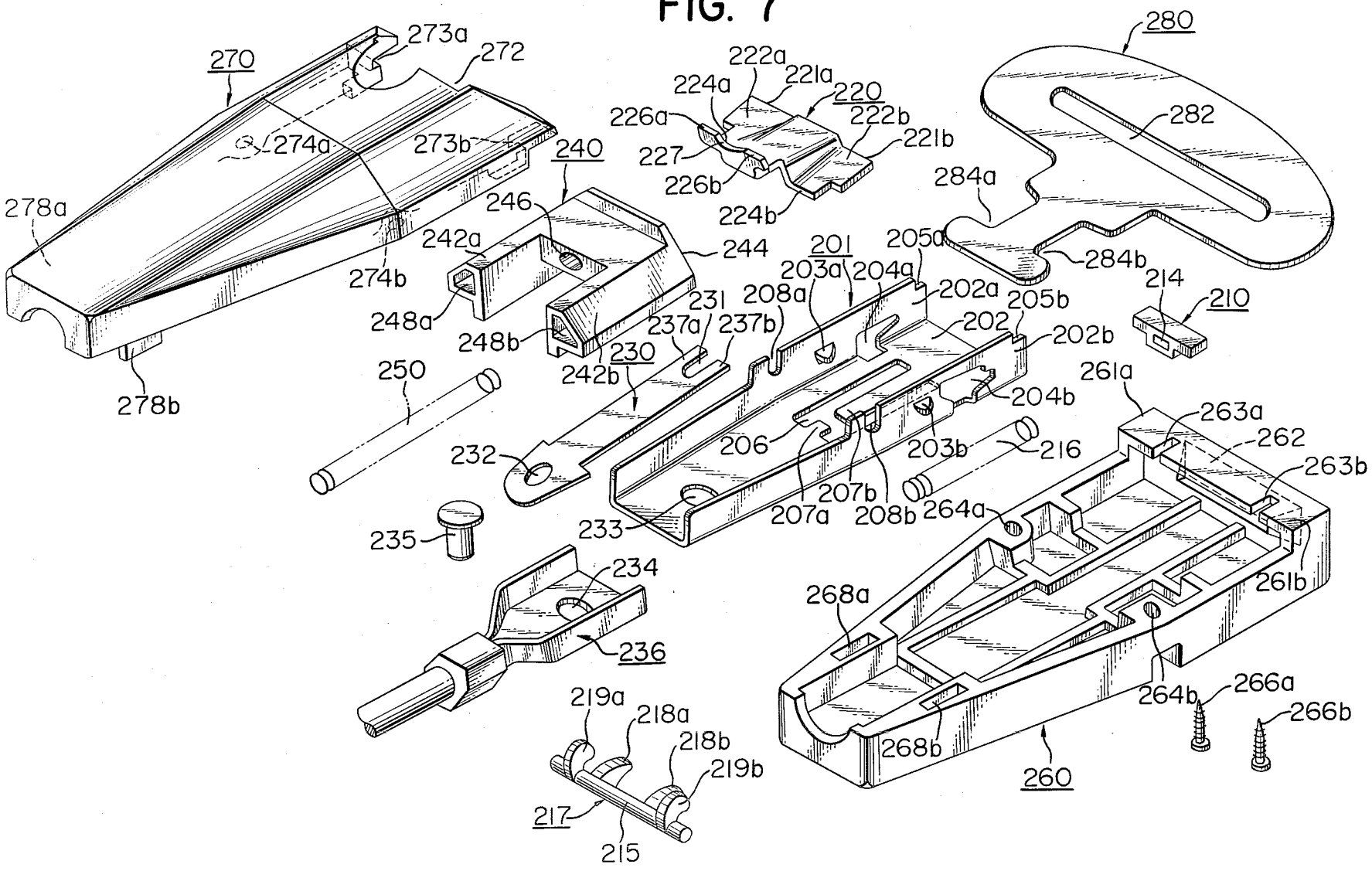
FIG. 7 is an exploded perspective view of a third embodiment of the present invention.

Now, there will be described a third embodiment of the present invention making reference to FIGS. 7 to 9.

The third embodiment chiefly includes a base member 201, a slider 210 disposed for longitudinally sliding on the base member, a latch member 220 having latch portions 224*a* and 224*b* disposed for pivotal movement on the base member 201, a plate spring 230 as part of the latching structure having one end secured to the member by a rivet 235 and the other end riding on upper ends 226*a* and 226*b* of a tail of the latch member 220, a lever member 217 having first arm portions 219*a*, 219*b* and second arm portions 218*a*, 218*b* and pivotally supported on the base member, a button member 240 having rearwardly projected bifurcated portions 242*a* and 242*b*, and a tongue 280 having cut-away portions 284*a* and 284*b* for engaging with the latch portions 224*a* and 224*b* of the latch member and an oblong opening 282 through which an unshown belt passes.

The base member 201, a member 236 having a circular hole 234, upper and lower cover members 270 and 260, the latch member 220, the plate spring 230, the slider 210, and the tongue 280 of this third embodiment are similar to the corresponding members of the first embodiment, except for rounded notches 208*a* and 208*b* formed in the up-standing portions 202*a* and 202*b* of the base member 201 for pivotally supporting the lever member 217. In the third embodiment shown in FIGS. 7 to 9, portions corresponding to the portions of the first embodiment are indicated by reference numerals made by adding of two hundred to the corresponding reference numerals of the first embodiment. Therefore, also with respect to the third embodiment only the different portions will be described.

The lever member 217 has a rod portion 215, the first arm portions 219*a* and 219*b* projecting upwardly from near the two ends of the rod portion 215, and the second arm portions 218*a* and 218*b* projecting forwardly and upwardly and disposed inwardly along rod portion 215 between the first arm portions 219*a* and 219*b* project.

The button member 240 is provided with rearwardly projecting bifurcated portions 242*a* and 242*b* at the rear ends of which are formed recesses 248*a* and 248*b*. The recesses 248*a* and 248*b* may be engaged with the first arm portions 219*a* and 219*b* of the lever member 217 when the button member 240 is slid rearwardly, whereby the lever member 217 is rotated counterclockwise to rotate the second arm portions 218*a* and 218*b* engaging the lower surface of the plate spring 230, as a result of which bifurcated end portions 237*a* and 237*b* are caused to move away from said base member 1 and to depart from the upper ends 226*a* and 226*b* of the tail of the latch member 220.

Last, a variation of a lower cover member with an illuminating device will be explained referring to FIGS. 10 to 15, which cover member may be used in the above-noted three embodiments.

Figure 10:
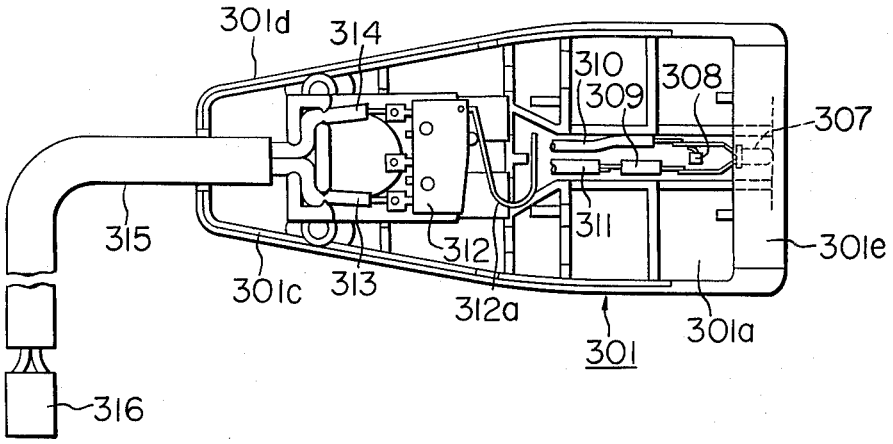
FIG. 10 is a plan view of a variation of a cover member.
Figure 11:
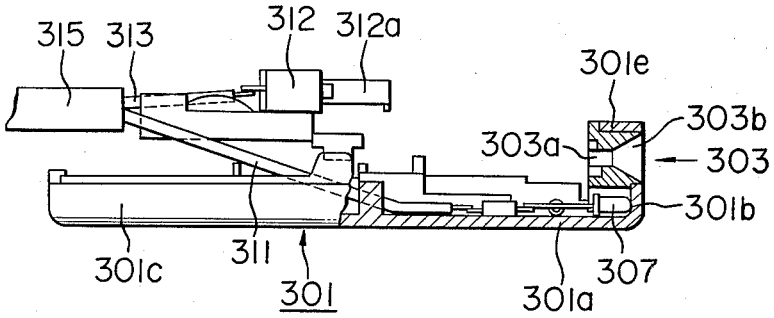
FIG. 11 is a partly sectional side view of the cover member of FIG. 10.
Figure 12:
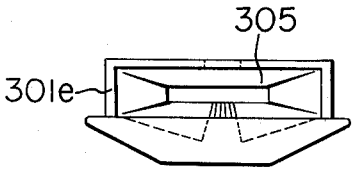
FIG. 12 is a right side view of the cover member of FIG. 10.
Figure 14:
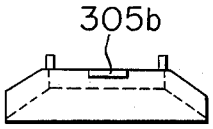
FIG. 14 is a plan view of the edge member of FIG. 13.
Figure 13:
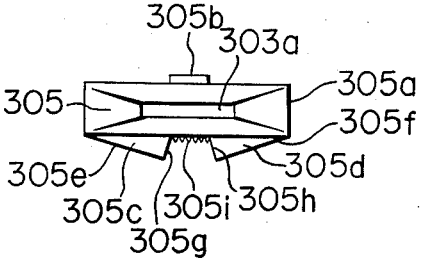
FIG. 13 is a front view of an edge member.
Figure 15:
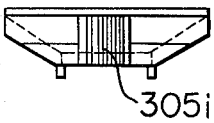
FIG. 15 is a bottom view of the edge member of FIG. 13.

In FIGS. 10 and 11, a cover member 301 has a flat bottom portion 301*a*, a front wall portion 301*b*, and side wall portions 301*c* and 301*d*, and this cover member may be molded from plastic or metal. The cover member 301 further has a rectangular supporting frame portion 301*e* in its foremost end (right end in FIGS. 10 and 11), and an edge member 305 made of transparent or semi-transparent material is securely inserted into the frame portion 301*e* to form a tongue insertion port 303. As clearly shown in FIGS. 13 to 15, the edge member 305 itself has a rectangular outer portion 305*a* for tightly fitting into the frame portion 301*e*. In the generally central portion of the outer portion 305*a* is formed a slot 303*a* for tongue insertion, and there is formed a tongue insertion inlet portion 303 extending from the slot 303*a* to the foremost end of the outer portion 305*a*, which portion 303*b* has outwardly enlarging inclined surfaces. That is, the tongue insertion port 303 is formed by the slot 303*a* and the inlet portion 303*b*. Furthermore, the edge member 305 has a projection 305*b* formed in the upper portion of its rear side and downwardly projected portions 305*c* and 305*d* formed in its lower side. The projection 305*b* and the projected portions 305*c* and 305*d* respectively engage the frame portion 301*e* and the front wall portion 301*b* lest the edge member 305 should slip off.

The downwardly projected portions 305*c* and 305*d* have inclined surfaces 305*c* and 305*f* projecting in the range from the side portion of the edge member 305 to the central portion thereof, which is complementary to the configuration of the bottom portion 301*a* of the cover member 301. The edge member 305 also has steeply inclined portion, 305*g* and 305*h* in the central portion thereof, and a portion 305*i* between the steeply inclined portions has a number of small prisms cut to provide means for scattering light. The surfaces of the edge member 305 facing the tongue insertion port and the rear surface thereof except the steeply inclined portions 305*g* and 305*h* have coating of white or other proper colors for reflecting light.

On the bottom portion 301*a* of the cover member 301 is secured a light emitting diode 307 as an illuminating source by proper adhesive agent, opposing the portion 305*i* which is formed with the light-scattering means. It is apparent that the light emitting diode may be substituted by a lamp and other proper light emitting elements. A Zener diode 308 for protection is connected to the LED 307 in parallel and a resistor 309 for limitation of electric current is connected to the LED 307 in series. Both of these electric elements 308 and 309 are also secured to the bottom portion 301*a* of the cover member 301.

Furthermore, a microswitch 312 is mounted to the bottom portion of the cover member 301. The microswitch 312 has a contact 312*a*, which may be engaged and pushed by a tip portion of the tongue when the tongue is inserted to put out the emitting source.

Leads 310 and 311 from the illuminating means and leads 313 and 314 from the microswitch 312 are guided by a resilient tube 315 to be connected to a proper connector 316. The above-noted electric circuit may be preferably closed when an ignition key is rotated to start an engine so as to turn the illuminating source on, and may be opened when the tongue is locked by the latch member to turn off the illuminating source.

From the construction above described, light from the illuminating source 307 may irregularly be reflected by small prisms in the portion 305*i* and be guided towards the tongue insertion port 303 from the steeply inclined portions 305*g* and 305*h* to be finally guided towards the outer portion of the tongue insertion port by the rear end face of the edge member 305.

By using such cover member, preferable illumination can be obtained when the buckle device is used in the dark, as a result of which the buckle device becomes more easily manipulated.

It is, of course, to be understood that the present invention is, by no means, limited to the specific showing in the drawing but also comprises any modifications within the scope of the appended claims.

What is claimed is:

1. A buckle device for a safety belt, comprising a casing having an entrance slot for receiving a tongue member, a latch member supported for pivotal movement in the casing at a position past which said tongue member moves as it enters the casing through said entrance slot, said latch member being engageable with said tongue member to hold the tongue member in the casing, first biasing means for biasing said latch member into engagement with said tongue member, a manually operable member supported for movement inwardly of said casing, second biasing means for biasing said manually operable member outwardly of said casing, said manually operable member and said latch member having cooperable elements integral therewith, respectively, one of said elements having a cam surface and the other of said elements having a surface that moves along said cam surface when said manually operable member is moved inwardly of said casing to transform that movement to pivotal movement of said latch member that disengages said latch member from said tongue member.

2. A buckle device in accordance with claim 1, wherein said latch member is a lever having a pivotal axis at a forward portion thereof adjacent to said entrance slot, having an intermediate portion that engages said tongue member, and having one of said cooperable elements at a rear portion thereof.

3. A buckle device in accordance with claim 2, wherein said cam surface is integral with said manually operable member and moves the cooperable element integral with said latch member to disengage the latch member from the tongue member when the manually operable member is moved inwardly of said casing.

4. A buckle device in accordance with claim 3, wherein said cam surface is a sloping surface that lifts the cooperable element integral with the latch member when the manually operable member is moved inwardly of said casing.

5. A buckle device in accordance with claim 2, wherein said cam surface is integral with said latch member and is moved by the cooperable element integral with said manually operable member to disengage the latch member from the tongue member when the manually operable member is moved inwardly of said casing.

6. A buckle device in accordance with claim 5, wherein the cam surface is a curved surface that is lifted by the cooperable element integral with the manually operable member when the manually operable member is moved inwardly of said casing.

7. A buckle device in accordance with claim 1, wherein said first biasing means comprises a plate spring, one end of which is fixed in said casing and the other end of which presses upon said latch member.

* * * * *